US007239249B2

(12) United States Patent
Stimson et al.

(10) Patent No.: US 7,239,249 B2
(45) Date of Patent: Jul. 3, 2007

(54) MENU SIGN SYSTEM

(75) Inventors: Anne H. Stimson, Pittsford, NY (US); Nathaniel G. Martin, Rochester, NY (US); Mary Ann Sprague, Macedon, NY (US)

(73) Assignee: Xerox Corporation, Stamford, CT (US)

( * ) Notice: Subject to any disclaimer, the term of this patent is extended or adjusted under 35 U.S.C. 154(b) by 164 days.

(21) Appl. No.: 11/082,531

(22) Filed: Mar. 17, 2005

(65) Prior Publication Data

US 2006/0220894 A1 Oct. 5, 2006

(51) Int. Cl.
*G08B 5/00* (2006.01)

(52) U.S. Cl. ..... 340/815.4; 345/173; 715/810

(58) Field of Classification Search ..... 340/815.4; 345/173; 715/810, 835, 838, 839
See application file for complete search history.

(56) References Cited

U.S. PATENT DOCUMENTS 4,016,490 A 4/1977 Weckenmann et al.
4,328,453 A 5/1982 Demeny et al.
4,329,634 A 5/1982 Dunfield et al.
4,395,740 A * 7/1983 Yuen et al. ..... 360/72.2
4,821,029 A 4/1989 Logan et al.
5,031,082 A 7/1991 Bierend
5,148,015 A * 9/1992 Dolan ..... 341/31
5,289,572 A * 2/1994 Yano et al. ..... 715/855
5,773,954 A * 6/1998 VanHorn ..... 320/137
6,573,880 B1 6/2003 Simoni et al.
6,859,141 B1 2/2005 Van Schyndel et al.
2002/0087598 A1* 7/2002 Carro ..... 707/513
2002/0138650 A1* 9/2002 Yamamoto et al. ..... 709/245

* cited by examiner

*Primary Examiner*—Thomas Mullen
(74) *Attorney, Agent, or Firm*—Pepper Hamilton LLP

(57) ABSTRACT

A method for controlling a menu sign linked to a light and a menu sign system are disclosed. The method may include highlighting an item entry on a menu sign and/or illuminating a light associated with an item. The item entry is associated with the item. The system includes a processor, a menu sign in communication with the processor, a light that is controlled by the processor; and a processor-readable storage medium in communication with the processor. The menu sign includes a plurality of item entries. An item entry and a light are each associated with the item.

20 Claims, 6 Drawing Sheets

MENU SIGN SYSTEM

TECHNICAL FIELD

The disclosed embodiments generally relate to the field of electronic displays. More particularly, the disclosed embodiments relate to methods and systems for coordinating a menu sign to items in an item display.

BACKGROUND

Many current display signs provide information pertaining to items with which they are co-located. For example, a retail display sign might describe an item with which it is associated and the price of the item. Such signs are helpful in providing information to consumers who are interested in purchasing such items.

One problem with traditional display signs is that they are static. In other words, information printed on a paper sign cannot be updated without marring the sign. Typically, the sign must be replaced when new information is assigned to the item with which the sign is associated or a new item replaces the previous item. The process of replacing each sign can be tedious and can require an expenditure of capital for new materials.

The advent of electronic signs provided a solution to this problem. An electronic sign can display information similar to that displayed on a paper sign. However, electronic signs do not require replacement when the price of an item or the item itself changes. Instead, the information displayed on the electronic sign can simply be updated to reflect the new pricing and/or item information.

In an effort to further reduce costs, menu signs have been introduced. Such signs list item information for a plurality of items located in a particular area. The sign may include a monitor or other display linked to a processor, wherein the display includes multiple fields for listing information about one or more items. Examples of such signs are disclosed in, for example, U.S. Pat. No. 6,573,880 to Simoni et al., which is incorporated herein by reference in its entirety. Accordingly, cost savings can further increase by consolidating multiple signs into one menu sign.

Additional advantages of menu signs include improving display appearance and improving communication with a user. Display appearance is improved because the number of signs is reduced. Instead of using one sign for each of a plurality of items in a display, a single sign can be used which displays information for a plurality of the items. In addition, user communication is improved. If multiple signs are used, user confusion as to which sign pertains to an item may result. However, when a menu sign is used, the sign pertains to the plurality of items in the display, and user confusion is reduced accordingly.

However, problems exist with current menu signs. One problem occurs when numerous items of the same or similar class are grouped together in an environment, as is typically the case in a retail environment. A menu sign in a retail environment could be used to display information pertaining to such items. However, a customer might be unable to determine which item pertains to a particular menu entry on the sign. For example, if a menu sign lists a series of wrenches and their prices, the consumer might not be able to distinguish one wrench from another and might select a wrench other than the anticipated selection. Similarly, if china patterns are displayed on a menu sign, a consumer might not be able to determine which china pattern corresponds to a particular menu entry. Such consumer confusion could result in additional retail costs due to return processing and/or lost sales.

What is needed is a method and system for using a menu sign that links a menu entry with an item to which it corresponds.

A need exists for methods and systems for detecting a user's selection of a particular item and highlighting information associated with the item on a menu sign.

A further need exists for methods and systems for drawing attention to items within a retail display with which a menu sign is associated.

The present disclosure is directed to solving one or more of the above-listed problems.

SUMMARY

Before the present methods, systems and materials are described, it is to be understood that this invention is not limited to the particular methodologies, systems and materials described, as these may vary. It is also to be understood that the terminology used in the description is for the purpose of describing the particular versions or embodiments only, and is not intended to limit the scope of the invention which will be limited only by the appended claims.

It must also be noted that as used herein and in the appended claims, the singular forms "a," "an," and "the" include plural references unless the context clearly dictates otherwise. Thus, for example, reference to a "menu sign" is a reference to one or more menu signs and equivalents thereof known to those skilled in the art, and so forth. Unless defined otherwise, all technical and scientific terms used herein have the same meanings as commonly understood by one of ordinary skill in the art. Although any methods, materials, and devices similar or equivalent to those described herein can be used in the practice or testing of embodiments of the invention, the preferred methods, materials, and devices are now described. All publications mentioned herein are incorporated by reference. Nothing herein is to be construed as an admission that the invention is not entitled to antedate such disclosure by virtue of prior invention.

In an embodiment, a menu sign system may include a processor, a menu sign in communication with the processor, a light that is controlled by the processor, and a processor-readable storage medium in communication with the processor. The menu sign may include a plurality of item entries. An item entry may be associated with an item. A light may also be associated with the item.

In an embodiment, a menu sign system may include a processor, a menu sign in communication with the processor, a movable light that is controlled by the processor, and a processor-readable storage medium in communication with the processor. The menu sign may include a plurality of item entries. Each item entry may be associated with an item. The processor-readable storage medium may contain one or more programming instructions for performing a method of linking an item to a menu sign that includes selecting an item entry, highlighting the item entry, directing the movable light towards the item associated with the item entry, and illuminating the movable light.

In an embodiment, a method of controlling a menu sign linked to a light may include highlighting an item entry associated with an item within a menu sign, and illuminating a light associated with the item.

BRIEF DESCRIPTION OF THE DRAWINGS

Aspects, features, benefits and advantages of the embodiments of the present invention will be apparent with regard to the following description, appended claims and accompanying drawings where:

DETAILED DESCRIPTION

As used within this disclosure, the term "illuminate," when used with respect to a light, means to turn on a light, to increase the intensity of a light, to alter a color of a light, to direct a light towards an object, and/or to focus a light on an object.

As used within this disclosure, the term "dim," when used with respect to a light, means to turn off a light, to decrease the intensity of a light, to alter the color of a light, to direct a light away from an object, and/or to defocus a light from an object.

Figure 1:
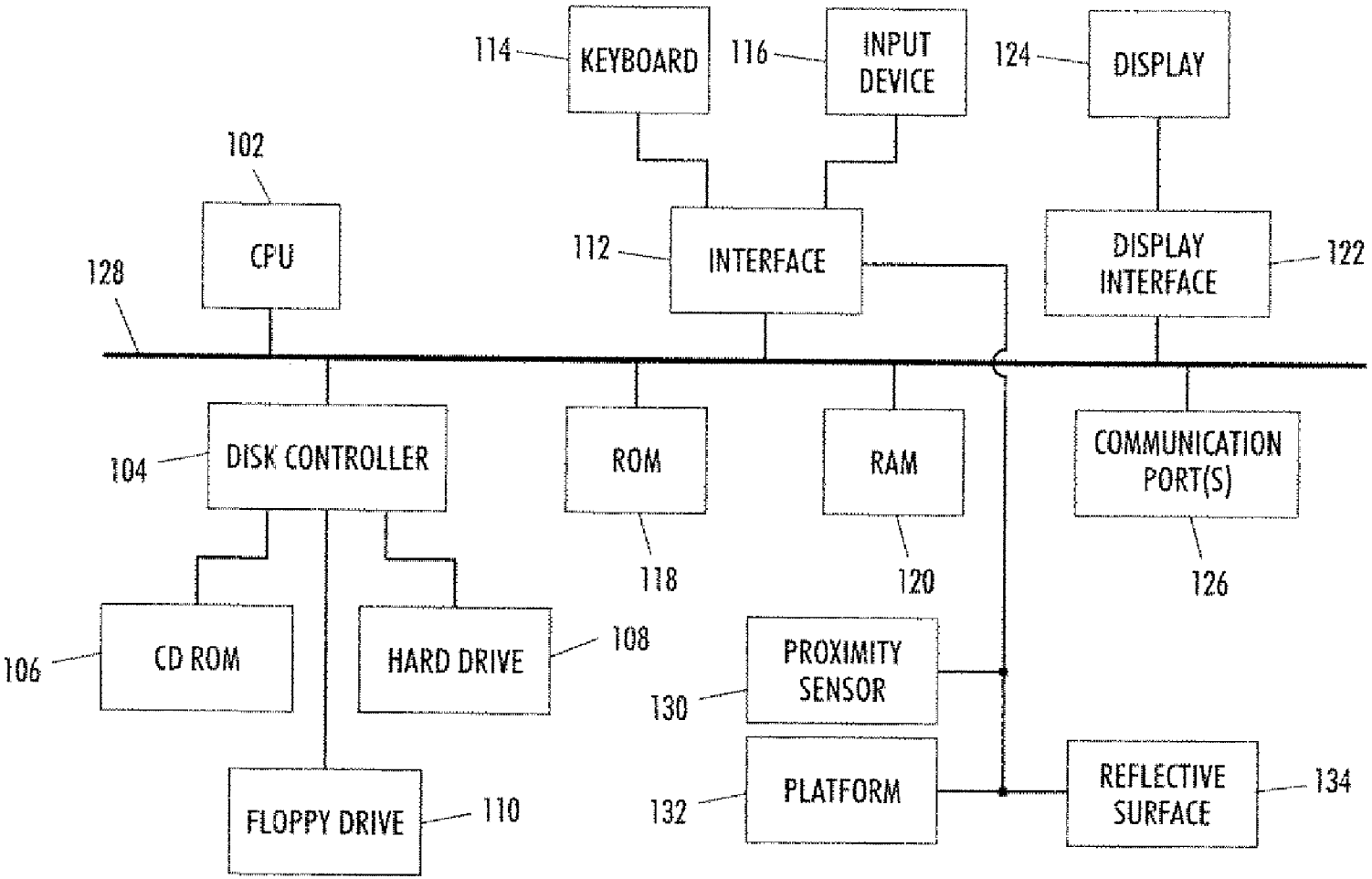
FIG. 1 is a block diagram of exemplary hardware that may be used to contain and/or implement the program instructions of a system embodiment.

FIG. 1 is a block diagram of exemplary hardware that may be used to contain and/or implement the program instructions of a system embodiment. Referring to FIG. 1, a bus 128 serves as the main information highway interconnecting the other illustrated components of the hardware. CPU 102 is a central processing unit of the system, performing calculations and logic operations required to execute a program. Read only memory (ROM) 118 and random access memory (RAM) 120 constitute exemplary memory devices.

A disk controller 104 may interface with one or more optional disk drives to the system bus 128. These disk drives may be external or internal memory keys, zip drives, flash memory devices, floppy disk drives 110 or other memory media such as CD ROM drives 106, or external or internal hard drives 108. As indicated previously, these various disk drives and disk controllers are optional devices.

Program instructions may be stored in the ROM 118 and/or the RAM 120. Optionally, program instructions may be stored on a computer readable medium such as a floppy disk or a digital disk or other recording medium, a communications signal or a carrier wave.

An optional display interface 122 may permit information from the bus 128 to be displayed on the display 124 in audio, graphic or alphanumeric format. Communication with external devices may optionally occur using various communication ports 126. An exemplary communication port 126 may be attached to a communications network, such as the Internet or an intranet.

In addition to the standard computer-type components, the hardware may also include an interface 112 which allows for receipt of data from input devices such as a keyboard 114 or other input device 116 such as a mouse, a remote control, pointer and/or joystick. A display including touch-screen capability may also be an input device 116. An exemplary touch-screen display is disclosed in U.S. Pat. No. 4,821,029 to Logan et al., which is incorporated herein by reference in its entirety.

An embedded system may optionally be used to perform one, some or all of the operations of the methods described below. Likewise, a multiprocessor system may optionally be used to perform one, some or all of the methods described below.

Figure 2A:
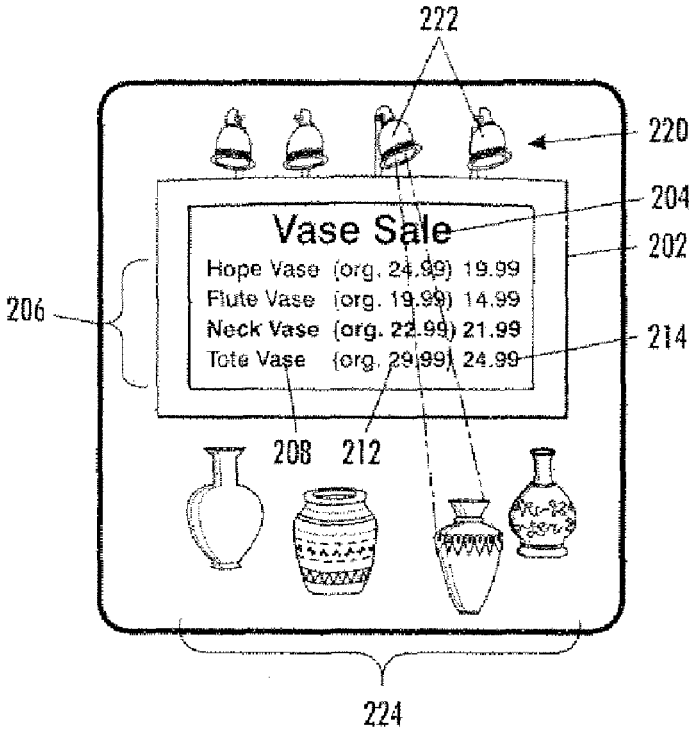
FIGS. 2A and 2B depict exemplary menu signs and a linked lighting system according to an embodiment.
Figure 2B:
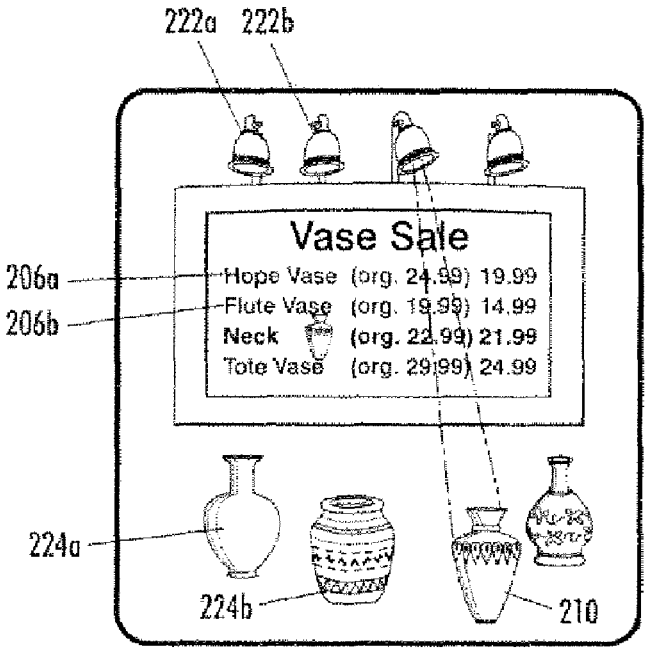

FIGS. 2A and 2B depict exemplary menu signs and a linked lighting system according to an embodiment. As used herein, a menu sign 202 may include any sign having a display that may be changed through the application of an electric field, signal or other control. A menu sign 202 may be capable of displaying text, numbers and/or graphics relating to one or more items. The display may include fixed fields in which the menu information is displayed, or it may be dynamic, such as a television screen or computer monitor, so that menu information may be displayed anywhere on the display. In an embodiment, one or more communication ports 126 may provide one or more communication paths between a processor and a menu sign 202. The menu sign 202 may include, for example, a title 204 and one or more item entries 206. In an embodiment, the item entries 206 may include an item name 208, an item description (not shown), and/or an item picture 210 or other text, graphics or numbers relating to an item. If the menu sign 202 is used in a retail environment, one or more item prices, such as an item retail price 212 and an item sale price 214, may also be included. Additional and/or alternate information may be displayed for each item or for the menu as a whole. In an embodiment, all item entries, such as 206, may be displayed on the menu sign 202 simultaneously. In an alternate embodiment, the menu sign 202 may have a scroll or other dynamic function (not shown) if each item entry 206 cannot be displayed simultaneously. With the function, the display may change over a period of time through scrolling, page turning, fade ins, and/or other display changing methods.

In an embodiment, one or more communication ports 126 may provide one or more communication paths between a processor and a lighting system 220. The lighting system 220 may include one or more lights 222 associated with one or more of the item entries 206 listed on the menu sign 202. The one or more lights 222 associated with a particular item entry 206 may be directed at one or more items, such as 224, corresponding to the particular item entry 206. In an embodiment, the one or more lights 222 may include one or more of a spotlight, a laser pointer, a bullet light, and the like. In an embodiment, a light may be adjusted or moved either manually or as a result of signals received from, for example, a processor.

Figure 3:
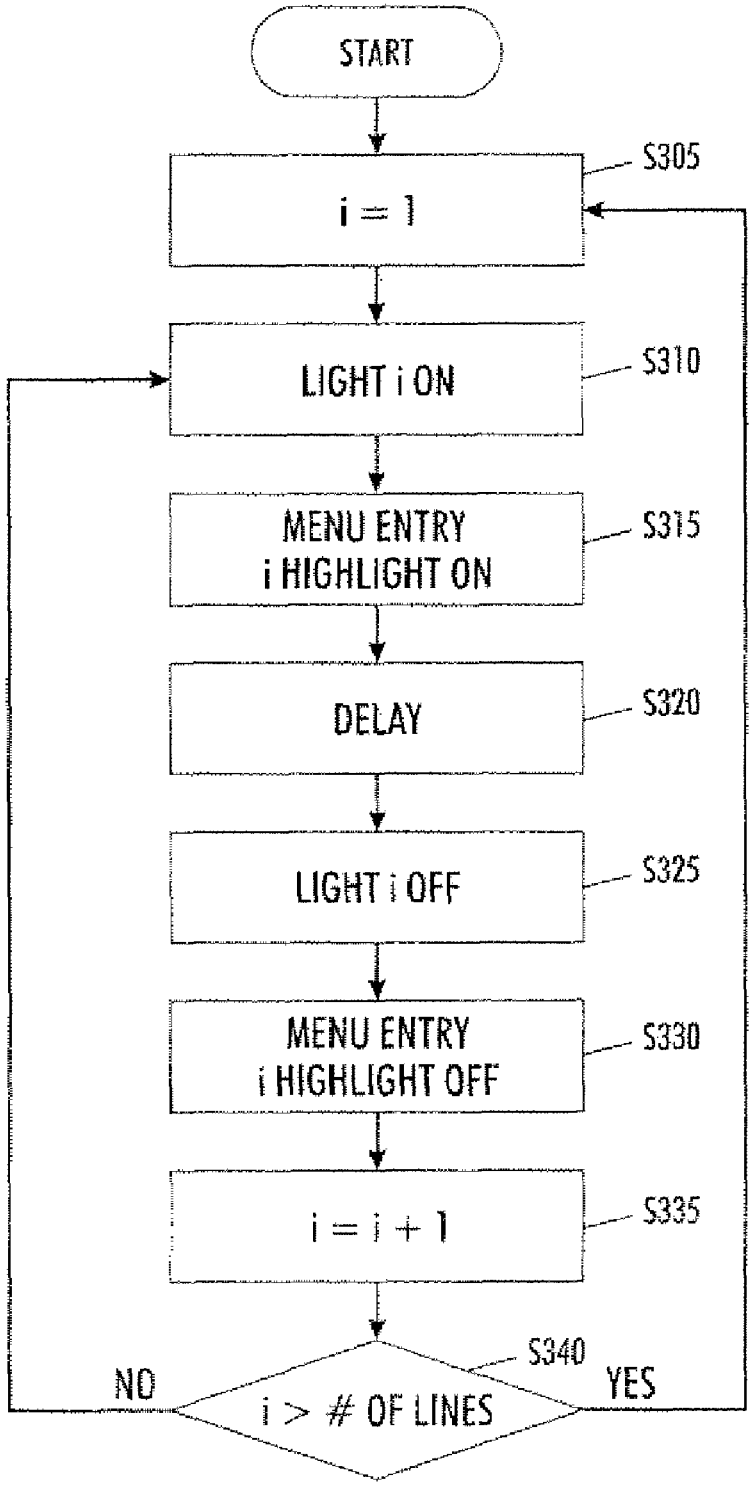
FIG. 3 depicts a flow diagram for an exemplary method of operating a menu sign and linked lighting system according to an embodiment.

FIG. 3 depicts a flow diagram for an exemplary method of operating a menu sign and linked lighting system according to an embodiment. In an embodiment, each item entry 206 may be assigned an item number corresponding to its place in the menu. For example, the item entry 206*a* at the top of the menu may be assigned a first value, such as "1," the item entry 206*b* below that item entry 206*a* may be assigned a second value, such as "2," and so on. The above numbering scheme is merely exemplary of potential numbering schemes and is not meant to be limiting. Alternate numbering schemes may be used within the scope of this disclosure.

In an embodiment, the system may provide an illumination system that guides a viewer to highlighted items appearing on the display. In this embodiment, the first item entry 206*a* may correspond to a first item 224*a* and one or more first lights 222*a*; the second item entry 206*b* may correspond to a second item 224*b* and one or more second lights 222*b*; and so on. A counter within the system may be initialized to the first value S305. When the counter is equal to the first value, the one or more first lights 222*a* may be illuminated S310 to draw attention towards the first item 224*a*, and the first menu entry 206*a* may be highlighted S315 on the sign 202, such as by increasing the brightness, changing the color, changing the size, increasing the intensity and/or reversing the video of text, numbers and/or graphics associated with the first menu entry 206*a*. After a pre-determined time delay S320, the first lights 222*a* may be dimmed S325 and the first menu entry 206*a* may be returned to normal S330. The counter may then be set to the next value S335, such as by incrementing the counter value. A determination of whether the new counter value is associated with a valid menu entry 206 is then made S340. If so, the counter may be reset to the first value S305. The method may update the counter value in each iteration indefinitely. In an embodiment, hardware, such as the exemplary hardware described in FIG. 1, may contain one or more programming instructions that provide signals to the menu sign 202 and/or the one or more lights 222 to perform these operations.

Figure 4A:
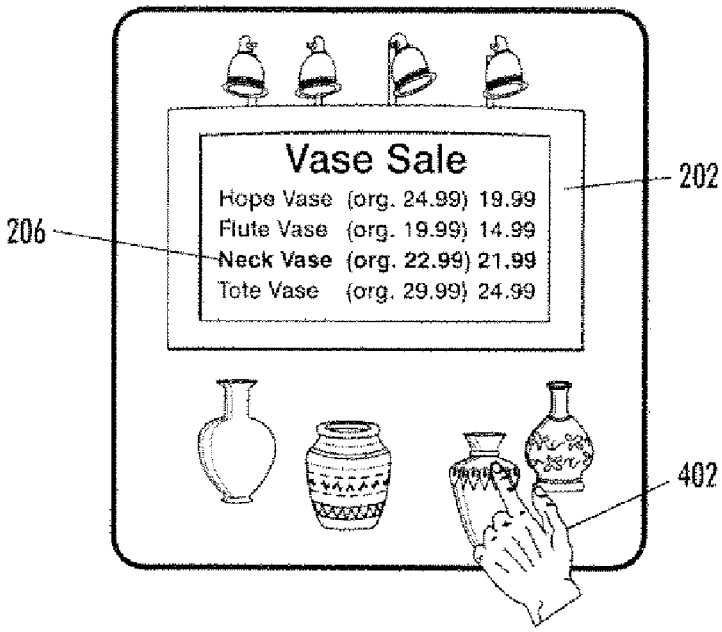
FIGS. 4A and 4B depict exemplary menu signs according to an embodiment.
Figure 4B:
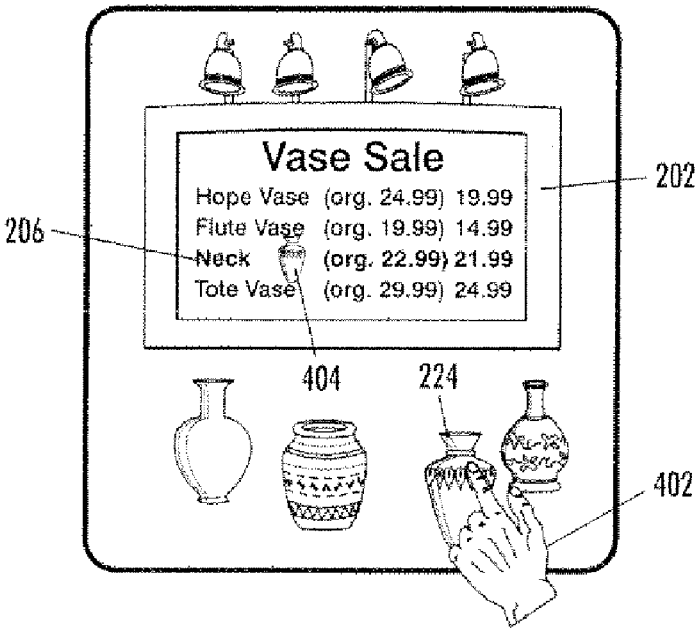

In another embodiment, the system may react to user interest in an item 224, such as by highlighting an item entry 206 when a user moves his or hand toward the item 224. FIGS. 4A and 4B depict exemplary menu signs according to an embodiment. FIG. 4A may show the exemplary menu sign 202 in an initial state. In an embodiment, when an individual places an object 402, such as the individual's hand, within a space proximate to an item 224 associated with the menu sign 202, the menu sign 202 may highlight the item entry 206 associated with the item 224, as shown in FIG. 4B. In an embodiment, an image 404 of the item 224 may be depicted within the item entry 206 on the menu sign 202 when the item entry 206 is highlighted. In an embodiment, the system may further include one or more lights 222 for each item 224. The lights 222 may illuminate the item 224 when an object is placed within a space proximate to the item 224.

In an embodiment, the object 402 may be sensed by any detection mechanism, such as a motion and/or proximity sensor system or any other system that can detect the movement or presence of an object near an item 224. Such sensor systems are well known by those of skill in the art, and may include ultrasound systems and systems using beams of light. Exemplary proximity sensor systems include the ones described in U.S. Pat. No. 4,016,490 to Weckenmann et al. and U.S. Pat. No. 6,859,141 to Van Schyndel et al., each of which is incorporated herein by reference in its entirety. Examples of motion sensor systems are disclosed in, for example, U.S. Pat. No. 4,329,634 to Dunfield et al. and U.S. Pat. No. 4,328,453 to Demeny et al., each of which is incorporated herein by reference in its entirety. In an embodiment, the detection of an object near an item 224 may result in information being transmitted to processing hardware, such as the exemplary hardware in FIG. 1. The processing hardware may execute one or more programming instructions and transfer information to the menu sign 202 to highlight the item entry 206 associated with the item 224. In an embodiment, additional or alternate programming instructions may be executed that depict an image 404 of the item 224. In an embodiment, alternate or additional programming instructions may be executed to illuminate one or more lights 222 associated with the item 224.

Figure 5:
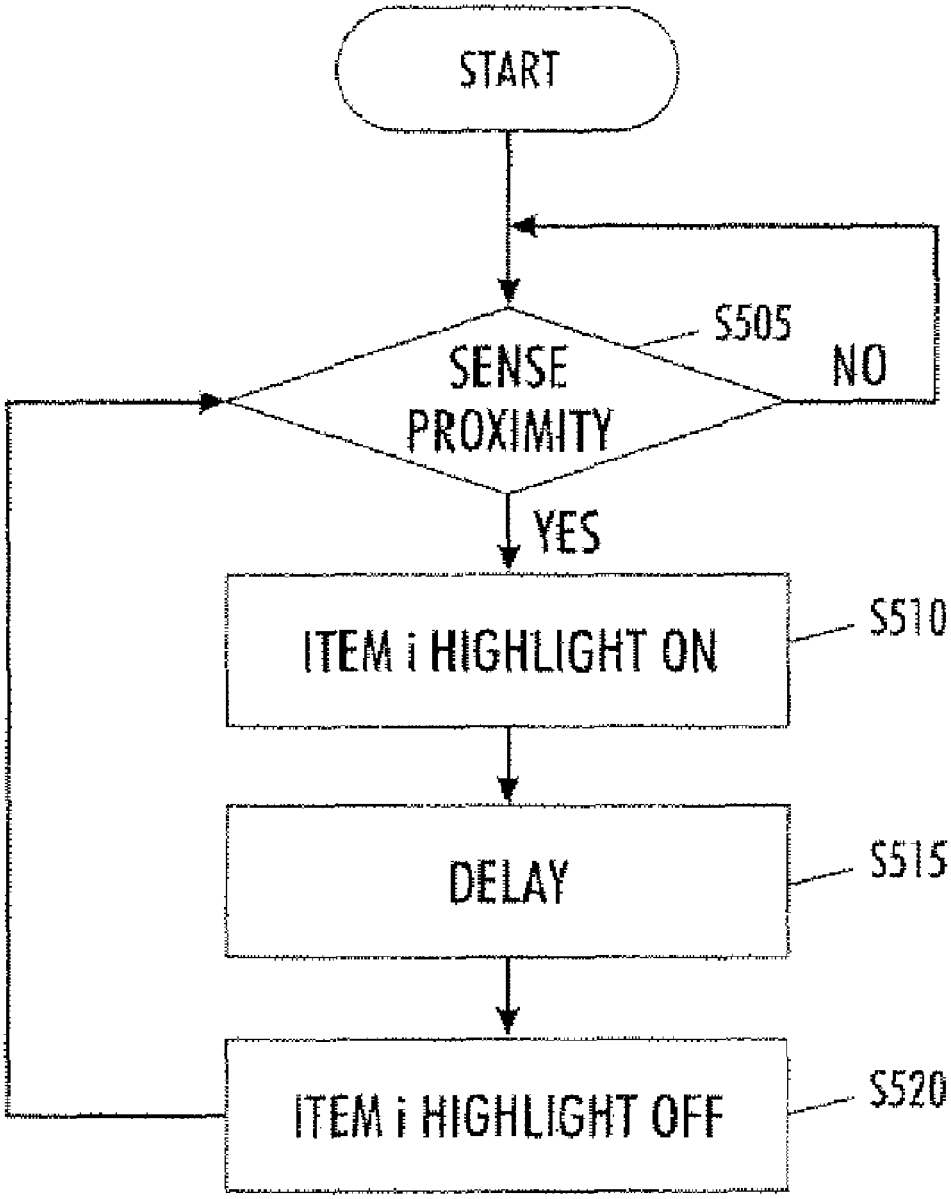
FIG. 5 depicts a flow diagram for an exemplary method of operating a menu sign according to an embodiment.

FIG. 5 depicts a flow diagram for an exemplary method of operating a menu sign according to an embodiment. In an embodiment, a detection mechanism may continuously or periodically sense whether an object has moved S505 within a space proximate to an item 224. When an object has moved within a space proximate to an item, the menu sign 202 may highlight S510 an item entry 206 associated with the item 224. In an embodiment, after a predetermined delay S515, such as a delay of 30 seconds, one minute, two minutes or another time period, the menu sign 202 may de-emphasize S520 the item entry 206. The detection mechanism may then reinitiate sensing whether an object has moved S505 within a space proximate to an item 224. In an alternate embodiment, the menu sign 202 may highlight the item entry 206 associated with the item 224 until an object, such as a user's hand, has moved within a space proximate to a second item.

In an embodiment, when an object has moved within the proximity of an item 224, one or more lights 222 may illuminate the item 224 concurrently with step S510. In an embodiment, the one or more lights 222 may be dimmed after a predetermined delay S515. In an alternate embodiment, the one or more lights 222 may remain illuminated until an object has moved within a space proximate to a second item.

Figure 6:
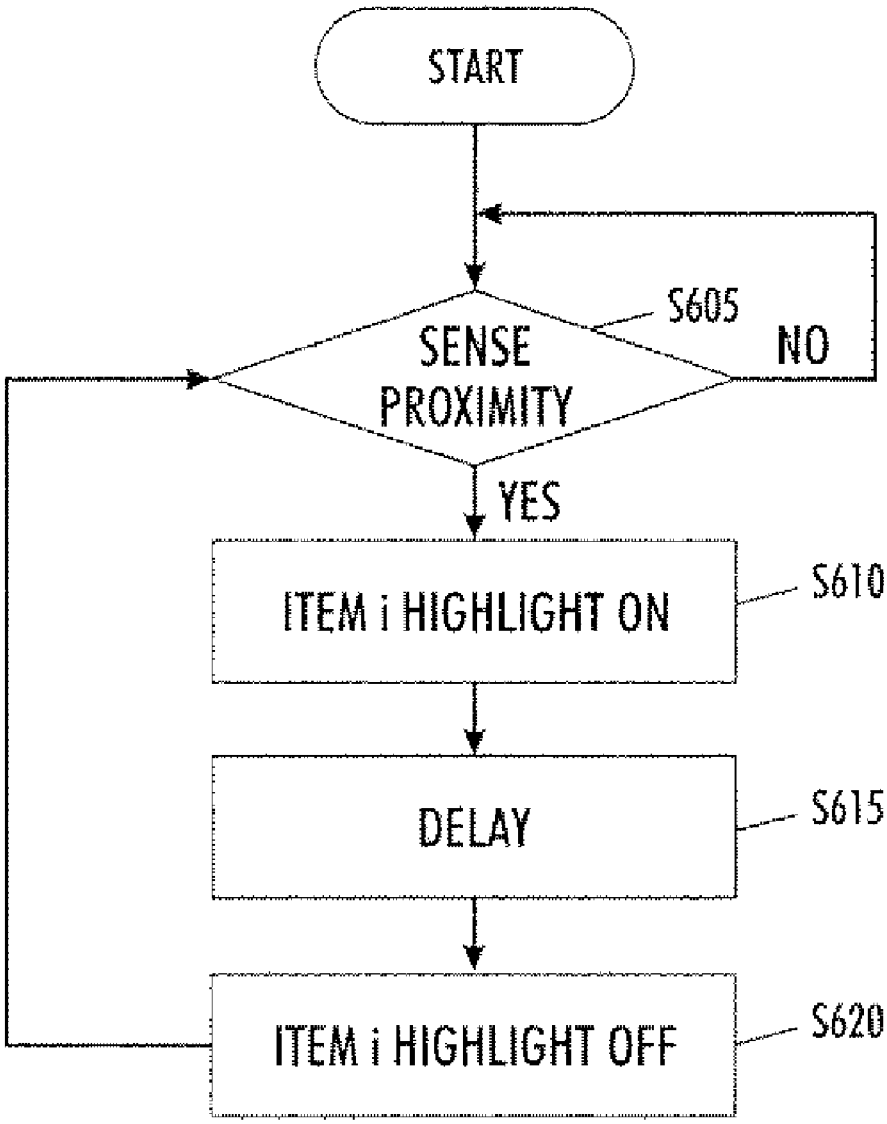
FIG. 6 depicts a flow diagram for an exemplary method of operating a menu sign and linked lighting system according to an embodiment.

FIG. 6 depicts a flow diagram for an exemplary method of operating a menu sign and linked lighting system according to an embodiment. In an embodiment, the menu sign 202 may include, for example, a touch screen or a proximity screen, examples of which are well known to those skilled in the art. An exemplary touch-screen display is disclosed in U.S. Pat. No. 4,821,029 to Logan et al., which is incorporated herein by reference in its entirety. If a user touches S605 the menu sign 202 in the location of an item entry 206, the menu sign 202 may highlight S610 the item entry 206, depict an image 404 of the item 224 associated within the item entry 206, and/or illuminate one or more lights 222 associated with the item entry 206. The one or more lights 222 may illuminate an item 224 associated with the item entry 206. In an embodiment, after a predetermined delay S615, the menu sign 202 may de-emphasize S620 the item entry 206 and/or dim the one or more lights 222. In an alternate embodiment, the menu sign 202 may highlight the item entry 206 and/or illuminate the item 224 until a second item entry is selected. When a second item entry is selected, the menu sign 202 may de-emphasize S620 the item entry 206 and/or dim the one or more lights 222, and highlight S610 the second item entry and/or illuminate the one or more lights associated with the second item entry.

In an embodiment, the menu sign system 202 may include, for example, a platform associated with an item 224. The item 224 may, for example, be placed on the platform. In an embodiment, if a user selects an item 224 or an item entry 206 by, for example, placing an object within a space proximate to the item 224 or touching a touch screen display at a location associated with an item entry 206, and/or the menu sign system 202 selects an item entry 206 by updating a counter value, the platform associated with the item entry 206 and/or item 224 may begin to operate. In an embodiment, the platform may be a rotating disc, cube, or other polyhedron or shape, a conveyor and/or any other movable area. In an embodiment, the platform may rotate or otherwise move when the item entry 206 and/or the item 224 associated with the platform is selected. In an alternate embodiment, at least a portion of the platform may be translucent and a light 222 may be placed within the platform. The light 222 may be illuminated when the item entry 206 and/or item 204 associated with the platform is selected. The platform may cease moving and/or the light 222 may dim when the item entry 206 and/or item 224 associated with the platform are deselected or a second item entry and/or second item are selected.

In an embodiment, one or more lights 222 may be controlled by signals from a processor. The signals may instruct the one or more lights 222 to reposition themselves towards a particular item 224 if the item and/or the item entry 206 associated with the item 224 are selected. The repositioning may be performed by, for example, operating motors that control the orientation of the one or more lights 222. Once the one or more lights 222 are repositioned, the one or more lights may be illuminated. If the item 224 and/or item entry 206 associated with the item 224 is deselected, the one or more lights 222 may dim. Alternately, the one or more lights 222 may return to a default position. In an alternate embodiment, the one or more lights 222 may be repositioned when a second item and/or second item entry associated with the second item are selected. An example of a movable lighting system is described in, for example, U.S. Pat. No. 5,031,082 to Bierend, which is incorporated herein by reference in its entirety.

In an embodiment, the one or more lights 222 may be programmed to point at a particular location by orienting the one or more lights 222 at an item 224 and entering information for the item entry 206 pertaining to the item 224. The menu sign system may correlate the orientation of the one or more lights 222 and the information for the item entry 206 in a database. When the item 224 and/or item entry 206 is selected, the one or more lights 222 may be directed to point at the item 224. An example of a method of coordinating a control system with an item is described in, for example, U.S. Pat. No. 4,630,567 to Bambousek et al., which is incorporated herein by reference in its entirety.

In an alternate embodiment, the orientation of the one or more lights 222 may be fixed, and one or more mirrors and/or other reflective surfaces (not shown) may be used to redirect light emitting from the one or more lights 222. The one or more mirrors and/or other reflective surfaces may be positioned to direct light at a particular item 224 when the corresponding item entry 206 and/or the item 224 is selected.

In an embodiment, when an item entry 206 is selected on the menu sign 202 or an item 224 is selected, a representation of the item 224, a map depicting a location of the item 224, an icon pointing towards and/or in the direction of the item 224 or depicting the location of the item 224, and/or any other information pertaining to the item 224 may be displayed. In an embodiment, a sound may be produced near the location of the item 224 or may otherwise inform a user of the location of the item 224.

For example, a menu sign 202 may be used to display a plurality of meeting locations for a conference. In an embodiment, a user may select a menu entry 206 pertaining to a particular meeting. The menu sign system, for example, may display a map of the place at which the conference is being held and highlight the location of the selected meeting within the map. In an embodiment, directions may be displayed on the menu sign 202. In an embodiment, one or more lights 222 may illuminate a doorway and/or a path leading to the meeting. In an embodiment, one or more lights 222 may illuminate a portion of a physical map depicting the location of the meeting. In an embodiment, one or more lights 222 may illuminate a portion of a model of at least a portion of a building (not shown) depicting the location of the meeting.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A menu sign system, comprising:

a processor;

a menu sign in communication with the processor;

a light that is controlled by the processor; and a processor-readable storage medium in communication with the processor, wherein the menu sign includes a plurality of item entries, wherein an item entry is associated with an item, wherein the light is associated with the item.

2. The menu sign system of claim 1 wherein the processor-readable storage medium contains one or more programming instructions for performing a method of linking the item to a menu sign, the method comprising:

highlighting the item entry associated with the item; and illuminating the light associated with the item.

3. The menu sign system of claim 1 wherein the processor-readable storage medium contains one or more programming instructions for performing a method of linking an item to a menu sign, the method comprising:

setting an item value;

highlighting an item entry associated with the item value;

illuminating a light associated with the item entry;

de-emphasizing the item entry;

dimming the light.

4. The menu sign system of claim 1 wherein the menu sign includes a proximity sensor, wherein the processor-readable storage medium contains one or more programming instructions for performing a method of linking an item to a menu sign, the method comprising:

detecting, via the proximity sensor, a location at which the menu sign is contacted;

determining, via the processor, an item entry associated with the location;

highlighting the item entry; and illuminating a light associated with the item entry.

5. The menu sign system of claim 1, further comprising a proximity sensor in communication with the processor; and wherein the processor-readable storage medium contains one or more programming instructions for performing a method of linking an item to a menu sign, the method comprising:

detecting, via the proximity sensor, whether an object moves within a space corresponding to the item; and if an object moves within the space, highlighting the item entry associated with the item.

6. The menu sign system of claim 5 wherein the processor-readable storage medium further contains one or more programming instructions for performing the following:

if an object moves within the space, illuminating the light associated with the item.

7. The menu sign system of claim 1 wherein a platform is associated with the item, wherein the processor-readable storage medium contains one or more programming instructions for performing a method of linking an item to a menu sign, the method comprising:

highlighting the item entry associated with the item; and moving the platform associated with the item.

8. The menu sign system of claim 1 wherein a platform is associated with the item, wherein a portion of the platform is translucent, wherein the light associated with the item is within the platform, wherein the processor-readable storage medium contains one or more programming instructions for performing a method of linking an item to a menu sign, the method comprising:

highlighting the item entry associated with the item; and illuminating the light associated with the item.

9. The menu sign system of claim 1, further comprising:

a reflective surface.

wherein the processor-readable storage medium contains one or more programming instructions for performing a method of linking an item to a menu sign, the method comprising:

illuminating the light, and positioning the reflective surface to direct light at the item.

10. A menu sign system, comprising:

a processor;

a menu sign in communication with the processor;

a movable light that is controlled by the processor; and a processor-readable storage medium in communication with the processor, wherein the menu sign includes a plurality of item entries, wherein each item entry is associated with an item, wherein the processor-readable storage medium contains one or more programming instructions for performing a method of linking an item to a menu sign, the method comprising:

selecting an item entry, highlighting the item entry, directing the movable light towards the item associated with the item entry, and illuminating the movable light.

11. A method of controlling a menu sign, the method comprising:

highlighting an item entry within a menu sign, wherein the item entry is associated with an item; and indicating a location of the item, wherein indicating a location of the item comprises illuminating a light associated with the item.

12. The method of claim 11, further comprising:

setting an item value;

de-emphasizing the item entry; and dimming the light, wherein the item entry is associated with the item value.

13. The method of claim 11 wherein the light is within a platform associated with the item, wherein a portion of the platform is translucent.

14. The method of claim 11 wherein illuminating a light associated with the item comprises:

positioning the light based on one or more electronic signals; and illuminating the light.

15. The method of claim 11 wherein illuminating a light associated with the item comprises:

illuminating the light; and positioning a reflective surface to direct light from the light.

16. The method of claim 11, further comprising:

detecting a position at which the menu sign is contacted; and determining the item entry associated with the position.

17. The method of claim 11, further comprising:

detecting, via a proximity sensor, whether an object moves within a space surrounding the item.

18. The method of claim 11, further comprising:

moving a platform associated with the item.

19. The method of claim 11, further comprising:

depicting a representation of the item on the menu sign.

20. The method of claim 11 wherein indicating a location of the item comprises one or more of the following:

producing a sound near the item; and depicting an icon signifying the location of the item.

* * * * *